United States Patent [19]

Ishii

[11] Patent Number: 4,777,876

[45] Date of Patent: Oct. 18, 1988

[54] PICTURE ADJUSTING DEVICE IN SHEET-FEED PRESS

[75] Inventor: Koji Ishii, Hiroshima, Japan

[73] Assignee: Ryobi Ltd., Hiroshima, Japan

[21] Appl. No.: 24,215

[22] Filed: Mar. 10, 1987

[30] Foreign Application Priority Data

Mar. 10, 1986 [JP] Japan ..... 61-53165

[51] Int. Cl.[4] ..... B41F 3/42

[52] U.S. Cl. ..... 101/177; 101/240; 101/246; 101/DIG. 12

[58] Field of Search ..... 271/251; 101/410, 409, 101/246, 177, DIG. 12, 232, 240; 226/180

[56] References Cited

U.S. PATENT DOCUMENTS 2,036,900 4/1936 Waldron ..... 226/100 X
3,247,790 4/1966 Nash ..... 101/177 X
3,384,011 5/1968 Bolza-Schünemann ..... 101/177
3,977,589 8/1976 Gentile ..... 226/180
4,362,098 12/1982 Stelling, Jr. et al. ..... 101/247 X

FOREIGN PATENT DOCUMENTS 2237567 2/1974 Fed. Rep. of Germany ..... 101/177

*Primary Examiner*—Clifford D. Crowder
*Attorney, Agent, or Firm*—Sughrue, Mion, Zinn, Macpeak, and Seas

[57] ABSTRACT

A picture adjusting device in a sheet-feed press having a rotating sheet-feed cylinder feeding paper to a rotating impression cylinder. The sheet-feed cylinder has a movable bearing on at least one end of its shaft so that the sheet-feed cylinder is tiltable with respect to impression cylinder, thereby allowing adjustment of the positioning of the picture on the page.

5 Claims, 3 Drawing Sheets

PICTURE ADJUSTING DEVICE IN SHEET-FEED PRESS

BACKGROUND OF THE INVENTION

1. Related Applications

This invention is related to U.S. patent application, Ser. No. 391,043, filed June 22, 1982, now abandoned, and to U.S. Pat. No. 4,350,093.

2. Field of the Invention

The present invention relates to a picture image adjusting device in a sheet-feed offset press.

3. Background of the Invention

When four-color printing is performed on a sheet-feed offset press, it is conventionally necessary to make each of first-color and second-color pictures register with the paper before the first-color and second-color pictures are made to register with each other. Then, it is necessary to make each of third-color and fourth-color pictures register with the paper on which the first-color and second-color pictures have been printed when the third-color and fourth color pictures are to be printed on the paper. If there is an error in plate making, torsion in plate attachment, or the like, the above-mentioned color pictures are not coincident with each other thus causing color slip, resulting in obscure printing.

There are conventional devices in which the slanting of a picture due to distortion in a plate or an error in picture registration between colors can be corrected. An example of such a device is disclosed in Japanese Utility Model Unexamined Publication No. 61940/1984. In this device, a previous guess is made with respect to an impression cylinder and slanting of the picture is adjusted. In the device disclosed in Japanese Utility Model Publication No. 19921/1976, a plate cylinder is distorted.

In the former device, however, there are problems in that the adjustment cannot be performed during operation of the press and in that the manufacturing cost is high because of its complicated structure.

In the latter device, on the other hand, there are problems that because the slant picture adjustment is performed by distorting the plate cylinder, the roller pressure and the plate pressure are finely changed so as to cause a difference in printing pressure of the roller between the central portion and its end portion to thereby cause unevenness in printing.

SUMMARY OF THE INVENTION

It is therefore an object of the present invention to eliminate the defects in the prior art devices.

It is a general object of the present invention to provide a picture adjusting device in a sheet-feed press provided with a paper-feed cylinder, which is arranged such that one end of the paper-feed cylinder is moved so as to be cocked relative to an impression cylinder to thereby change the positional relation between the printing paper and the picture so that slanting in the picture can be adjusted.

It is another specific object of the invention to provide a picture adjusting device, for example, in the case of four-color printing, in which torsion of the picture relative to the printing paper can be adjusted simply, in a short time and even during the time of rotation of the press by only performing picture registration of the first color and the second color.

It is another specific object to provide a mechanism which can be simplified to reduce the manufacturing cost.

To attain the above objects, according to the present invention, the picture adjusting device in a sheet feed press comprises a frame, an impression cylinder, a paper feed cylinder, and a shaft of the paper feed cylinder supported at its opposite ends by the frame through respective bearings. One of the bearings is supported by the frame through torsion means arranged so as to make it possible to give torsion to the paper feed cylinder relative to the impression cylinder.

These and other objects of the invention will be understood with reference to the description, taken in connection with the accompanying drawings.

DETAILED DESCRIPTION OF PREFERRED EMBODIMENT

Figure 2:
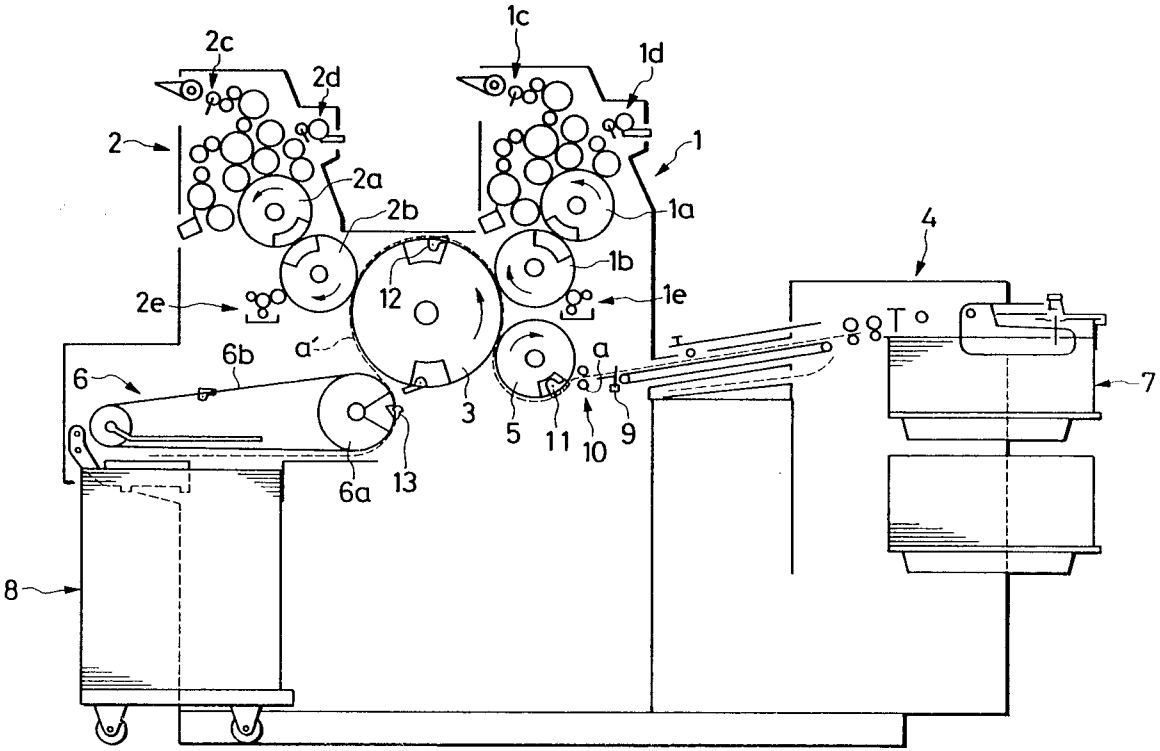
FIG. 2 is a schematic side view of a two-color press to which the embodiment of FIG. 1 is applied.
Figure 4:
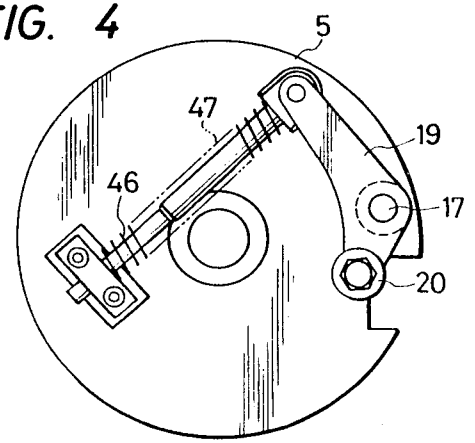
FIGS. 4 and 5 are transverse sections respectively taken on lines IV—IV and V—V in FIG. 1.

Referring to the drawings, an embodiment according to the present invention is described hereunder. FIG. 2 shows a side view of a two-color press. As shown in the drawing, the two-color press is constituted by main members such as a first printing section 1, a second printing section 2, a base impression cylinder 3 used also as a paper delivery cylinder, a paper feed section 4, a paper feed cylinder 5, a paper discharge section 6, a paper feed stand 7, a paper discharge stand 8, and other elements.

The first and second printing sections 1 and 2 are respectively constituted by plate cylinders 1*a* and 2*a* each having the same diameter, inked impression cylinder 1*b* and 2*b*, ink supply sections 1*c* and 2*c*, water supply sections 1*d* and 2*d*, blanket cleaning sections 1*e* and 2*e*, and so on.

The diameter of each of the paper feed cylinder 5 and of a sprocket 6*a* of the paper delivery section 6 provided adjacent to the base impression cylinder 3 is made to be equal to the diameter of each of the plate cylinders 1*a* and 2*a* and of the blanket cylinders 1*b* and 2*b* of the first and second printing section 1 and 2. These diameters are also set to be half of the diameter of the base impression cylinder 3.

In the thus arranged press, a cycle of printing is completed through such steps that paper a fed from the paper feed section 4 sheet by sheet is subject to preregistration by means of a needle 9. The paper a is then fed to the paper feeding cylinder 5 through a paper insertion mechanism 10, transferred to the base impression cylinder 3 while being gripped by a gripper 11 of the paper feed cylinder 5, and gripped by a gripper 12 of the base impression cylinder 3 so as to be printed with a first color at the first printing section 1 while being transferred to the second printing section 2. The sheet of paper a is then printed with a second color at the second printing section 2 and the thus twice printed paper a' is transferred while being gripped by a gripper 13 provided on a chain 6*b* of the paper delivery section 6 so as to be discharged onto the paper delivery stand 8.

In such a press provided with the paper feed cylinder 5 in front of the base impression cylinder 3, according to the present invention, the paper feed cylinder 5 is cocked (its shaft is swung) relative to the base impression cylinder 3 to distort the paper a so as to be gripped by the gripper 12 of the base impression cylinder 3 by changing over the gripping means for the paper a. A specific arrangement of the change-over means will be described hereunder.

As shown in FIGS. 1 and 3 through 5, a plurality of gripper holders 14 having grippers 15 and stoppers 16 fixed thereon are fixed on a gripper shaft 17 by means of bolts 18 at suitable axial intervals. A cam lever 19 (FIG. 4) is fixed on the gripper shaft 17 at one end of the gripper shaft 17. A spring guide 47 externally provided with a spring 46 is slidably supported at its one end by a wheel 25 described later. The cam lever 19 is pivoted at the other end of the spring guide 47. A cam follower 20 pivoted at the other end of the cam lever 19 is made to be in contact with a doughnut-like cam 24 (FIG. 1) fixed by means of bolts 23 through a holder 22 on a frame 21 on the non-operation side so that the grippers 15 can be opened and closed by rotating the gripper shaft 17 forward and backward.

The gripper shaft 17 is supported rotatably and in parallel to a paper-feed cylinder shaft 29 by a plurality of wheels 25, 26 27, and 28 fixed on the paper-feed cylinder shaft 29. Gripper receivers 30 are fixed on the wheels 25 through 28.

The paper-feed cylinder shaft 29 is supported at its opposite ends by bearings 31 and 32 respectively. The bearings 31 and 32 are supported by bearing pressing members 33 at the frames 21 and 21' on the non-operation side and on the operation side respectively so that the paper-feed cylinder shaft 29 is rotatably mounted between the frames 21 and 21'. A gear 35 fixed to the wheel 28 by means of bolts 34 or the like is engaged with a not-shown gear of the base impression cylinder 3 so that the paper feed cylinder 5 is driven to rotate by the base impression cylinder 3.

Figure 1:
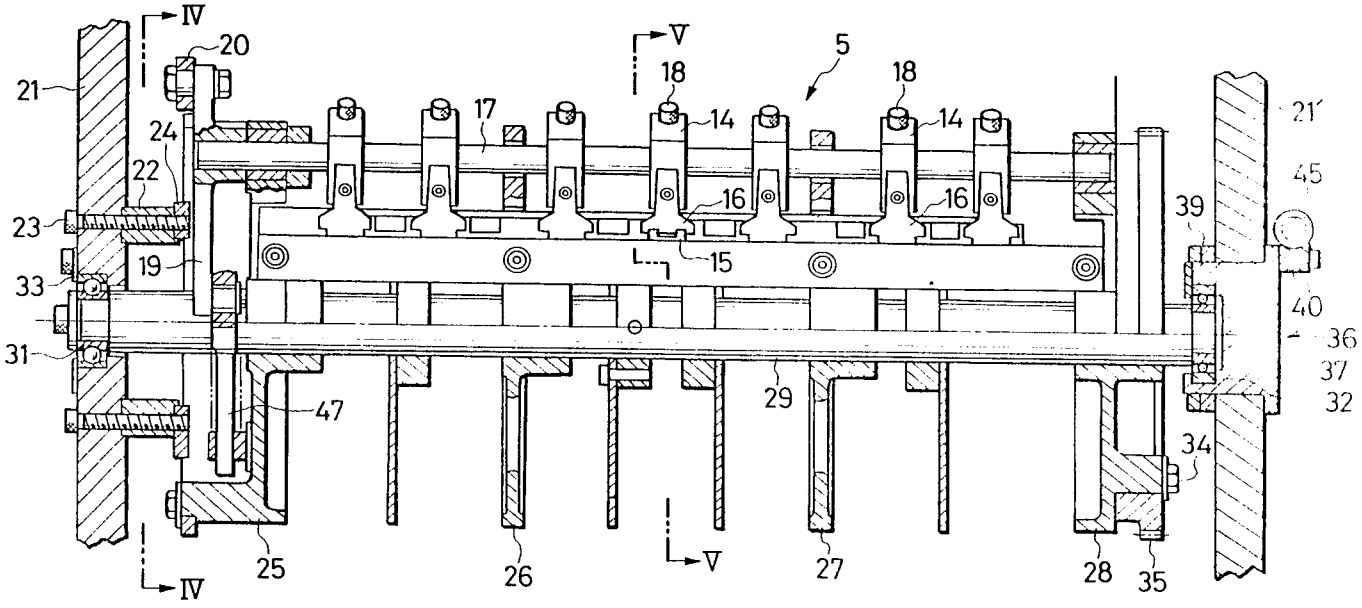
FIG. 1 is a longitudinal front view in section showing an embodiment of the picture adjusting device in a sheet feed press according to the present invention.
Figure 6:
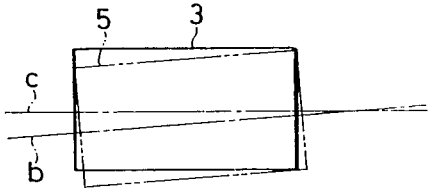
FIG. 6 is an explanatory view showing the relation between an impression cylinder and a paper-feed cylinder in the embodiment of FIG. 1.

One of the bearings of the paper feed cylinder shaft 29, that is, the bearing 32 on the operation or right side in FIG. 1 is supported by the frame 21' through torsion means 36 so that the paper feed cylinder 5 can be cocked relative to the base impression cylinder 3 by the torsion means 36 as shown in FIG. 6 to suitably distort the paper a so as to be gripped by the gripper 12 of impression cylinder 3 by changing over the gripping means of the paper a', thereby making it possible to adjust or correct the relation between the paper a and a picture, for example, such as a slant picture or the like.

Figure 3:
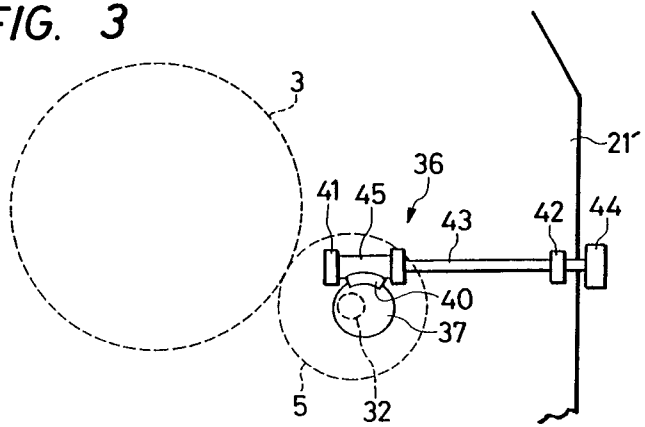
FIG. 3 is a front view showing an example of torsion means in the embodiment of FIG. 1.
Figure 5:
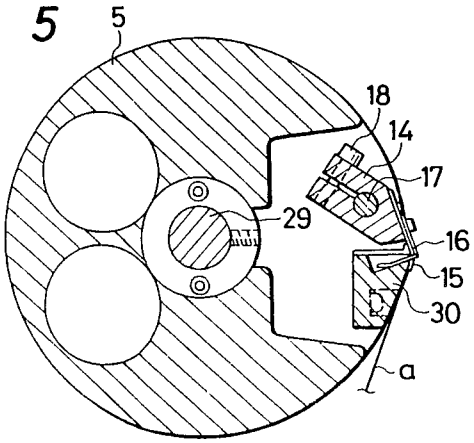

In the illustrated embodiment, the torsion means 36 is arranged, as shown in FIGS. 1 and 3 such that the bearing 32 is held by an eccentric holder 37. The eccentric holder 37 is rotatably fitted in an attaching hole in the frame 21' and fixed by a nut or the like so as not to come off. A worm wheel 40 is fixed to the eccentric holder 37 at a circumferential side portion thereof. An operation shaft 43 having a dial knob 44 is fixed at one end of the operation shaft 43 is mounted so as to be rotatable but so as not to be axially movable on holders 41 and 42 fixed on the frame 21'. A worm gear 45 is fixed on the operation shaft 43 and engaged with a worm wheel 40 so that when the operation shaft 43 is rotated by the dial knob 44, the eccentric holder 37 is rotated through the worm gear 45 and the worm wheel 40 to thereby cause the longitudinal center axis b of the paper-feed cylinder 5 to be moved (cocked) relative to the longitudinal center axis c of the base impression cylinder 3 as shown in FIG. 6.

It is a matter of course that the positional relation between the eccentric holder 37 and the bearing 32 held by the holder 37 is set such that the distance between the eccentric holder 37 and the bearing 32 is determined in advance so as not to allow the distance between the center axis c of the impression cylinder 3 and the center axis b of the paper feed cylinder 5 to change to an unnecessary extent.

A rotation mechanism for the eccentric holder 37 is not limited to that described above but may be formed such that an arcuate elongated hole (not shown) is formed in the eccentric holder 37, and a bolt (not shown) is inserted in the elongated hole and screwed into the frame 21' to thereby make the eccentric holder 37 rotatable in a range of the effective length of the elongated hole.

Further, instead of the eccentric holder 37, a groove (not shown) may be formed in the frame 21' and the bearing 32 is movably fitted in the groove to adjust its position so that the bearing 32 is fixed at the adjusted position by means of a bolt (not shown) or the like.

Being arranged in such a manner as described above, the picture adjusting device in the sheet feed press according to the present invention is advantageous in that when there is an error in plate making, torsion in plate attachment, or the like, the paper feed cylinder 5 is cocked relative the impression cylinder 3 by the torsion means 36 so as to make the paper a be gripped by the gripper 12 in a desirably distorted state by changing the gripping means. As a result, it is possible to eliminate such an inconvenience that a slight change occurs in roller pressure as well as in plate pressure or a difference in printing pressure occurs between the central portion and the end portion of a roller as in the conventional device in which a slant picture is made adjustable by distorting a plate cylinder.

Further, the conventional device had such a disadvantage that, for example in the case of performing four-color printing, it was necessary to make each of first-color and second-color pictures register with the paper before the first-color and second-color pictures were made to register with each other. Then it was necessary to make each of third-color and fourth color pictures register with the paper on which the first-color and second-color pictures had been printed when the third-color and fourth color pictures were to be printed on the paper. In the device according to the present invention, on the contrary, torsion of a picture relative to paper a can be corrected only by registering the first-color and the second-color picture, and therefore the slant adjustment between the paper a and the picture can be performed through an easy operation by using only the torsion means 36 in a simple manner, in a short time, and even while driving the machine, resulting in reduction in cost of the device because of its simple structure. Further, if the other bearing 31 of the paper feed cylinder shaft 29 is supported by the frame 21 through torsion means like the torsion means 36 similarly to the bearing 32, it is possible to adjust the picture with respect to the positional relation between the top and bottom as well as distortion of a picture.

What is claimed is:

1. A picture adjusting device in a plural-color sheet-feed press having a base impression cylinder and, for each color to be printed, a plate cylinder and an inked impression cylinder disposed parallel to said base impression cylinder, said picture adjusting device comprising:

a frame, said base impression cylinder and said plate and inked impression cylinders being rotatably supported on said frame;

a rotatable paper-feed cylinder for feeding paper to said impression cylinder, said paper-feed cylinder being separate from said base impression cylinder and said plate and inked impression cylinders; and bearing means for supporting a shaft of said paper-feed cylinder at its opposite ends by said frame, at least one of said bearing means including support means movable in a plane substantially perpendicular to said shaft, whereby said paper-feed cylinder has a rotation axis tiltable relative to a rotation axis of said base impression cylinder to adjust a placement of a sheet of paper fed to said base impression cylinder relative to said plate and inked impression cylinders.

2. A picture adjusting device as recited in claim 1, wherein said movable support comprises a rotatable holder having a support eccentric to a rotation of said holder for holding said one bearing.

3. A picture adjusting device as recited in claim 2, further comprising a worm gear coupled to said holder for rotating said holder.

4. A picture adjusting device as recited in claim 3, further comprising gripper means on said paper-feed cylinder for selectively gripping said paper during a portion of a rotation of said paper-feed cylinder.

5. A picture adjusting device as recited in claim 4, further comprising gripper means on said base impression cylinder for selectively gripping said paper fed by said paper-feed cylinder

* * * * *